United States Patent [19]

Burysek et al.

[11] Patent Number: 4,895,313

[45] Date of Patent: Jan. 23, 1990

[54] TRAVELLING SERVICE UNIT FOR EXCHANGING WOUND BOBBINS

[75] Inventors: František Buryšek, Ûstí nad Orlieí ; Pavel Andrlík, Liberec, both of Czechoslovakia

[73] Assignee: Vyzkumny ustav bavlnarsky, Usti nad Orlici, Czechoslovakia

[21] Appl. No.: 249,485

[22] Filed: Sep. 23, 1988

[30] Foreign Application Priority Data

Sep. 24, 1987 [CS] Czechoslovakia ..... 6837-87

[51] Int. Cl.[4] ..... B65H 67/04; B65H 67/06

[52] U.S. Cl. ..... 242/35.5 A

[58] Field of Search ..... 242/35.5 A, 35.5 R, 242/35.6 R; 57/268, 270, 271, 273, 275

[56] References Cited

U.S. PATENT DOCUMENTS

| | | | |
|---|---|---|---|
| 3,791,126 | 2/1974 | Kose et al. | 242/35.5 A |
| 3,879,925 | 4/1975 | Yoshizawa et al. | 242/35.5 A X |
| 4,015,786 | 4/1977 | Slavik et al. | 242/35.5 A |
| 4,171,779 | 10/1979 | Kamp | 242/35.5 A |
| 4,591,106 | 5/1986 | Gay | 242/35.5 A X |
| 4,615,493 | 10/1986 | Teranishi et al. | 242/35.5 A |
| 4,657,194 | 4/1987 | Wey et al. | 242/35.5 A |

*Primary Examiner*—Stanley N. Gilreath
*Attorney, Agent, or Firm*—Klein & Vibber

[57] ABSTRACT

A travelling service unit prevents full bobbins removed from bobbin holders from assuming an unwanted position when being laid onto a conveyor belt. According to the invention, the travelling service unit is provided with bobbin gripping means attached to conveying means. The latter is arranged on the frame of the travelling unit for swinging about a longitudinal pivot extending in parallel to the conveyor belt, together with the gripping means and a full bobbin, transversely to the space above the conveyor belt, by driving means.

9 Claims, 1 Drawing Sheet

TRAVELLING SERVICE UNIT FOR EXCHANGING WOUND BOBBINS

FIELD OF THE INVENTION

The invention relates to a travelling service unit for exchanging wound bobbins removed from bobbin holders and for transferring them onto a conveyor belt arranged on a textile machine, by bobbin gripping means and conveying means as well as by driving means coupled to an operation control unit.

BACKGROUND OF THE INVENTION

In the Czechoslovak Inventorship Certificate No. 188,085 there is disclosed a device for exchanging wound bobbins taken off bobbin holders for empty tubes. The device comprises a conveying channel arranged for swinging about a pivot and is provided with a forcing-out wedge for releasing the bobbin, and a positively swingable transferring arm with a cam which is in an active connection with a follower on a balance beam arranged fro swinging on said conveying channel while another follower on said channel is coupled with a cam provided on the device frame. During the bobbin exchange, the conveying channel, after unlocking an arresting pin, will swing downwards by gravity and surround the package on the bobbin in the bobbin holder. By the action of the forcing out wedge, the bobbin is disengaged from clamping discs of the bobbin holders so that it falls, due to its own weight, into the conveying channel. The conveyor channel and the transferring arm are then positively swung upwards together with the full bobbin where, under assistance of the cam and the balance beam mechanism, the bobbin is delivered onto a chute on which it slides by gravity up to a conveyor belt extending along the bobbin holders on the machine frame.

This known device is disadvantageous because the full bobbin, after having slid upon the chute, is not always deposited into the conveyor belt in the correct position whereby, when being transferred at the belt end to another device such as a packeting or another automatic mechanism for bobbin manipulation and delivery, some troubles may occur. Such a drawback is not even avoidable by providing the conveyor belt with channel-forming guide walls. Especially disadvantageous is the use of this device for conical bobbins which may get jammed and assume, with their minor diameter end, a different position every time. During such malpositioning, the package may be damaged.

Another known device according to the U.S. Pat. No. 4,355,859 comprises, on the travelling service unit, arms for forcing the full bobbin out of the bobbin holders, and has similar disadvantages are referred to hereinabove. After the full bobbin has been disengaged from the bobbin holders, it is transferred to a sheet metal chute on which it slides downwards by its own weight onto a conveyor belt. Since the chute slope is oriented perpendicularly to the direction of a running conveyor belt, it is just the transition between the chute and the running belt that causes the full bobbin to assume an incorrect position on the belt.

According to the U.S. Pat. No. 4,171,779 there is also known a device for exchanging full bobbins for empty tubes, said device being also adapted for travelling along the bobbin holders on the textile machine. The device is provided with gripping means designed for somewhat lifting the full bobbin, after releasing the bobbin holders, whereupon the bobbin is transferred to conveying means by which it is carried up to the end of the machine. Here the bobbin is disengaged from said conveying means and slides on a chute, by gravity, onto a conveyor belt. Thus, the displacement of the full bobbin from the chute onto the conveyor belt is, in this case, also uncontrollable which gives rise to the same drawbacks as with the devices previously referred to.

SUMMARY OF THE INVENTION

It is an object of the present invention to eliminate the disadvantages of prior art as hereinabove set forth and to provide an improved device for exchanging wound bobbins taken off bobbin holders for empty tubes and for transferring the former onto a conveyor belt in such a way which prevents them from assuming an undesired position on the belt, whereby the package on the bobbin is protected to the maximum extend from being damaged, the device being relatively simple and reliable in operation.

This object is achieved by providing a travelling service unit for exchanging wound bobbins removed from bobbin holders of a textile machine and for transferring them onto a conveyor belt arranged on the textile machine along said bobbin holders, by bobbin gripping and conveying means together with driving means coupled to an operation control unit.

According to the invention, the gripping means is attached to the conveying means arranged on the frame of the travelling service unit so that said conveying means together with said gripping means and the full bobbin may be swung, by driving means, transversely to the space above the conveyor belt about a longitudinal pivot extending in parallel to said conveyor belt.

An advantage of the device of the invention is that the bobbin is seized by grippers and transferred to above the conveyor belt onto which it is deposited always in one and the same position. Both the bobbin gripping and conveying means are simple and reliable in operation.

According to a preferred embodiment of the device, the bobbin gripping means comprising a swinging gripper and a sliding gripper which both serve for seizing the full bobbin at its outer diameter and which are coupled to each other by a common pivot, said swinging gripper having, outside said common pivot, a control arm coupled to driving means secured to a sliding arm having a sleeve at its end, said sleeve being coupled by means of a pivot to driving means and being adapted to slide along a guide rod and to swing together with it, said guide rod being integral with one arm of a toggle lever arranged for swinging about the longitudinal pivot, while its other or control arm is coupled by a pivot to driving means whose other end is journalled about a pivot on the frame of the travelling service unit.

Such a kinematic coupling of the individual device nodes is relatively simple, since the bobbin transfer takes place by a swing motion of the conveying means about a pivot, whereas the grippers are brought to a point above the bobbin by a sliding motion of the gripping device. The gripping means, together with the conveying means, actually form an integral unit controlled by driving means coupled to the operation control unit, said driving means preferably comprising pneumatic power cylinders.

To secure a safe position control of the bobbin gripping and conveying means, there is provided on the frame of the travelling service unit a travel control sensor for monitoring the closed grippers during the travel of the gripping means as well as a bobbin transfer control sensor for monitoring the bobbin transfer position of the conveying means together with the gripping means above the conveyor belt, said sensors being connected to a control unit.

To achieve an ever constant deposition of the bobbin onto the conveyor belt, it is preferable that the driving means for moving the gripping means along the guide rod comprises a pair of pneumatic power cylinders coupled with each other in series.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
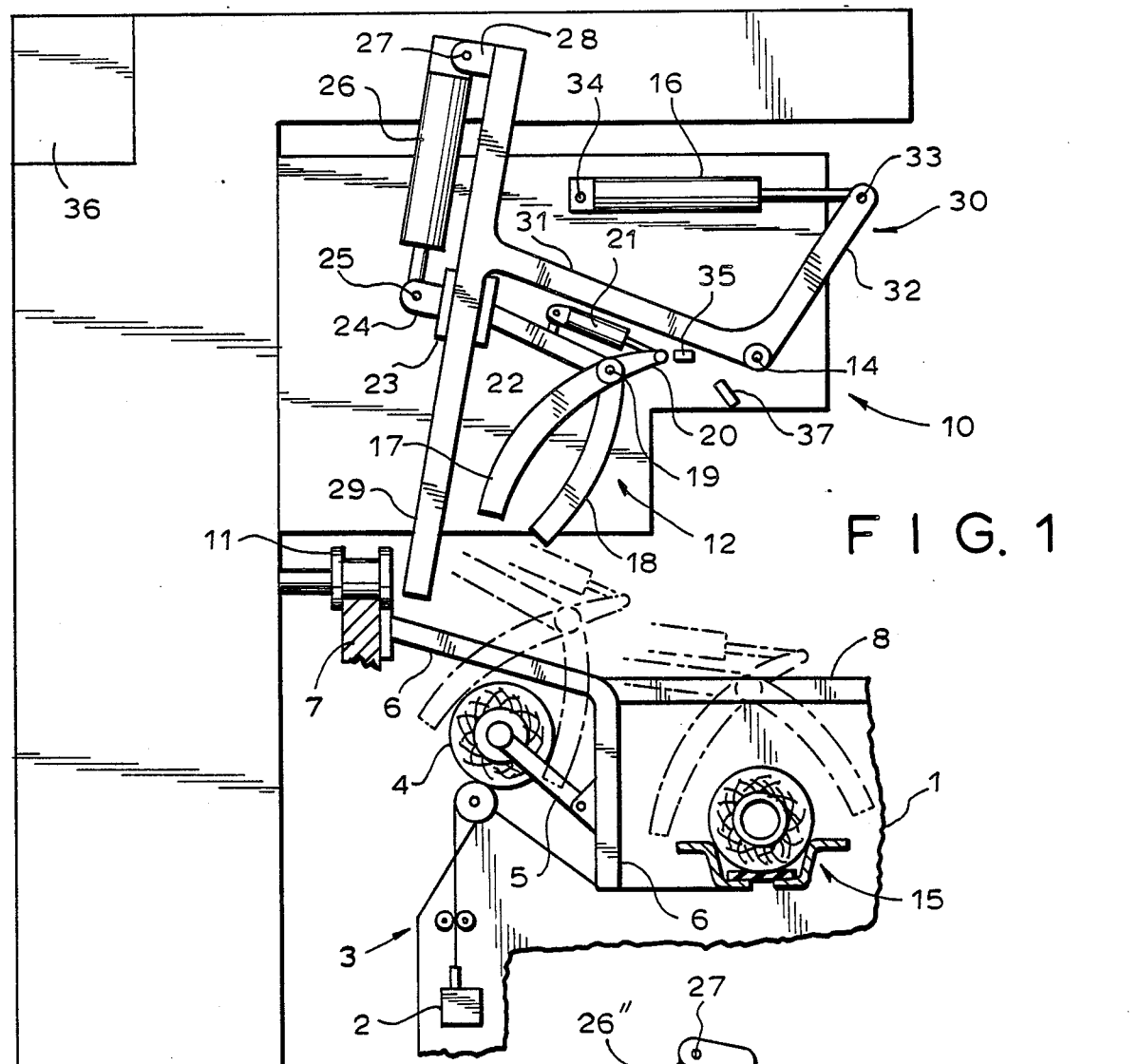
FIG. 1 is a side view of the travelling service unit showing those elements thereof only that immediately relate to the subject matter of the invention, and wherein full lines indicate the travel mode of the unit while dotted lines indicate, on the one hand, the position of grippers of the gripping means when removing the bobbin out of the bobbin holders, and, on the other hand, the position thereof when transferring it onto the conveyor belt.

Referring to FIG. 1, a textile machine has a frame 1 on which working units 2, such as spinning units, are arranged side-by-side. Above each of the spinning units 1 there are provided winding devices 3 comprising well-known take-off rollers and a driving roll (not shown) supporting a bobbin 4 to be wound, said bobbin being clamped in bobbin holders 5. Bobbin holders 5, when exchanging a full bobbin for an empty tube, can be spaced apart from one another. In case of stationary or firm bobbin holders, the wound bobbin can be forced out from springloaded cups thereof between which it is clamped.

The machine frame 1 is divided into sections, and at the end of each section there are provided side walls 8 extending upward in the form of holders 6 which support rails 7 extending along the machine frame 1. The rail 7 at the opposite side of the machine is not shown in the drawing. The rail 7 together with another supporting rail (not shown) in the lower machine part serve for carrying a service unit 9 for exchanging full bobbins 4 removed from the bobbin holders 5 for empty tubes, said unit 9 being adapted for travelling along the machine.

The travelling service unit 9 comprises a plurality of not shown means not only for exchanging bobbins 4 and spacing apart the bobbin holders 5 but also for inserting empty tubes, maintenance of work units, cleaning, yarn spinning-in etc.

As can be seen in the drawing, and particularly FIG. 1 thereof, the service unit 9, whose wheels 11 are supported by the rails 7, comprises bobbin conveying and gripping means 10 and 12, respectively, which serve for the bobbin exchange. The conveying means 10 is arranged on the frame 13 of the travelling service unit 9 for swinging about a longitudinal pivot 14 extending in parallel to a conveyor belt 15 provided in the upper part of the machine frame 1, said means 10 and 12 being swung transversely into the space above the conveyor belt 15 by driving means 16, while holding full bobbin 4 removed from said bobbin holders 5.

The gripping means 12 preferably comprise two grippers 17, 18, i.e. a swinging gripper 17 and a sliding gripper 18, both of them serving for seizing the full bobbin 4 at its external diameter. The two grippers 17, 18 are journalled about a common pivot 19. The swinging gripper 17 which is idle on the pivot 19, is provided with a control arm 20 which is coupled to driving means 21, such as a pneumatic power cylinder, by a pivot (not numbered).

The driving means 21 is secured to a sliding arm 22 which is connected to or forms an integral part of said sliding gripper 18. At the end of said sliding arm 22, there is provided a sleeve 23 which is arranged on said sliding arm 22 for swinging by means of side pivots (not shown). The sleeve 23 is provided with a bracket 24 with a pivot 25 for attaching the output element of driving means 26 such as a piston rod of a pneumatic power cylinder. At its other end, the driving means 26 is attached by a pivot 27 to a bracket 28 on a linear guide rod 29 on which said sleeve 23 is mounted for sliding.

The conveying means 10 comprise a toggle lever 30 attached to the frame 13 of the travelling service unit 9 by means of the longitudinal pivot 14. One arm 31 of said toggle lever 30 is secured to said linear guide rod 29 while the end of the other or control arm 32 thereof is coupled by means of a pivot 33 with the piston rod of the driving means 16 mounted for swinging about a pivot 34 on the frame 13 of the travelling service unit.

The driving means 16, 21 and 26 are preferably constituted by pneumatic power cylinders but, alternatively, electromagnetic drives, solenoids, or the like may be used for this purpose.

The grippers 17 and 18 can be arranged on the common pivot 19 either for swinging, or kinematically coupled with each other by well-known geared elements so that the motion of one gripper will cause the motion of the other.

In the exemplary embodiment, the sliding gripper 18 forms an integral part with the sliding arm 22 and is given its motion about the common pivot 19 by sliding the sleeve 23 along the guide rod 29.

On the frame 13 of the travelling service unit 9, there is further provided a conveying sensor 35 for monitoring the closed grippers 17 and 18 of the gripping means 12 during the travel of the unit 9 along the machine. The sensor 35 as well as control valves of said driving means 16, 21 and 26, and another bobbin transfer control sensor 37 provided on said frame 13 and serving for monitoring the position of the bobbin conveying and gripping means 10 and 12, respectively, above the conveyor belt 15, and are operatively connected to a central control unit 36 by not shown means.

MANNER OF OPERATION

In operation, the automatic service unit 9 travels on the rail 7 and stops, in a well-known way, at that working unit 2 where it is ascertained, by means of diameter feeler or another measuring device (not shown), that the bobbin 4 has reached the desired dimension (i.e. is filled) and is to be doffed and replaced by a fresh empty tube. The travelling service unit 9 is designed for effecting some other steps related to the bobbin exchange, such as cleaning of the spinning unit, preparation for spinning-in or the like, but these are not the subject of this invention.

Before doffing the full bobbin 4 and transferring it onto the conveyor belt 15, the central control unit 36 sets in operation the driving means 26 which causes the sleeve 23 to move downward along the guide rod 29. Simultaneously, the unit 36 starts also the other driving means 21 which opens the grippers 17 and 18. As the sleeve 23 has reached its lower most position, the grippers 17, 18 are fully open and encompass the external bobbin diameter. Then central control unit 36 will reverse the driving means 21 to cause said grippers to seize the bobbin 4, whereupon the driving means 16 is set in operation whereby the entire bobbin conveying means 10 is swung transversely into the space above the conveyor belt 15, while the sleeve 23 is moved somewhat upward by the driving means 26. At the beginning of this swing motion, the full bobbin is disengaged from the bobbin holders 5. Alternatively, the bobbin holders 5 can be opened by a not shown device after the bobbin has been clamped by the grippers 17 and 18.

After the conveying means 10 and the gripping means 12, together with the bobbin 4 have assumed the position above the conveyor belt 15, which is monitored by the control sensor 37, the central control unit 36 restarts the driving means 26 so that the bobbin 4 is deposited on the belt 15 whereupon, due to the action of the driving means 21, the grippers 17 and 18 are re-opened, and the bobbin 4 laid on the belt 15 is disengaged whereby the bobbin transfer is finished.

Thus, the bobbin 4 is always given the correct position on the belt 15 and cannot be upset or otherwise displaced. Then, the driving means 26 is again set in reverse operation and causes the sleeve 23 to move upward together with the gripping means 12 while the conveying means 10 is simultaneously swung by the driving means 16 back until it attains the initial position for the travel. Simultaneously, the grippers are brought in their initial position. The attainment of the initial position of the bobbin conveying means 10 is monitored by the travel controlling sensor 35 which makes the service unit 9 free for travel to another working unit 2. While the full bobbin 4 is exchanged by the above-described device, it is always controlled during the transfer so that it is prevented from being laid onto the conveyor belt 15 in an incorrect position and from being damaged.

Empty tubes are then donned into the bobbin holders 5 by means of another, not shown device.

Figure 2:
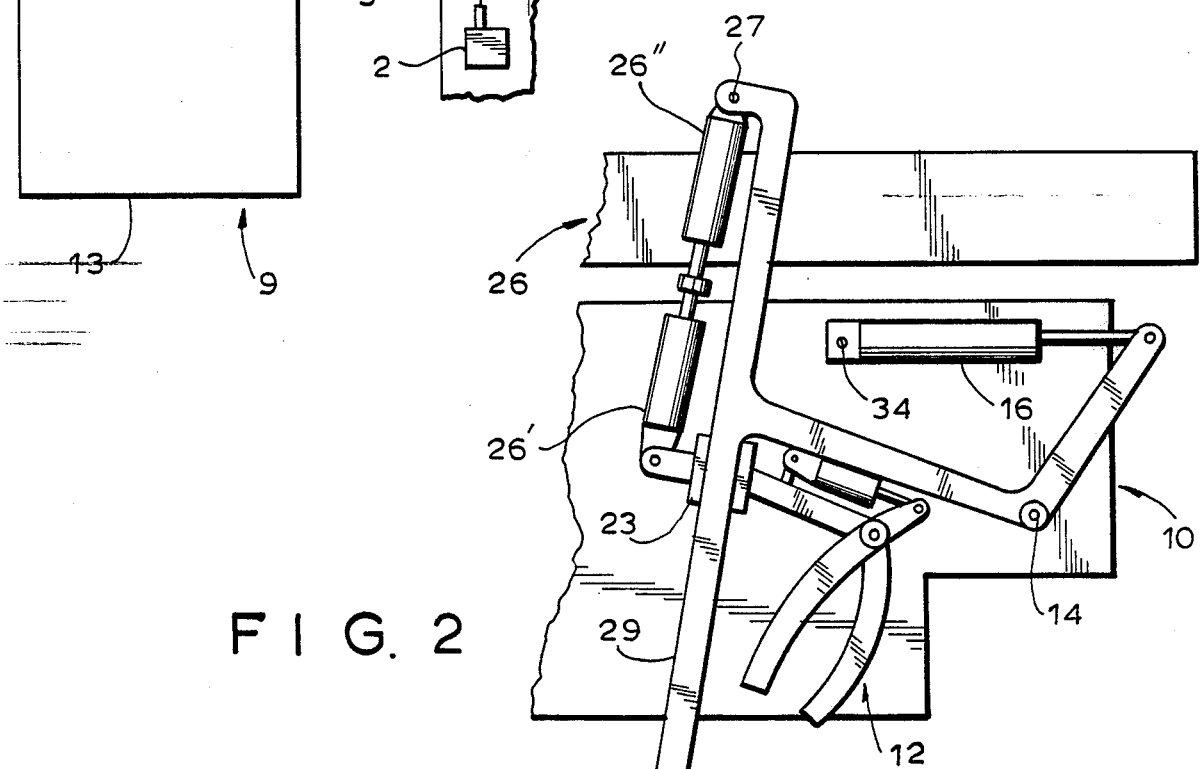
FIG. 2 a similar detail view showing another embodiment of the driving means.

The invention is suitable to be used with those textile machines where the bobbin 4 is arranged above the conveyor belt 15 and where no structural obstacle therebetween exists. In case the bobbin 4 is arranged lower than the belt 15 or any obstacle of this kind is to be overcome on its way from the bobbin holders 5 to said belt 15, the bobbin 4, after having been gripped by the grippers 17, 18 and after releasing the bobbin holders 5 by not shown means, has to be somewhat lifted by starting for an instant the driving means 26, whereby the gripping means 12 is displaced upwards. Thereafter, the conveying means 10 is set in operation by starting the driving means 16 whereby the gripping means 12 is displaced by a transverse swing over the conveyor belt 15. By the driving means 16 of the gripping means 12, the sleeve 23 is caused, together with the grippers 17, 18 to move downward to the conveyor belt 15. Due to the opening of the grippers 17, 18 by the driving means 21, the bobbin 4 is transferred on the conveyor belt 15. To facilitate this process, it is advantageous for the driving means 21, the bobbin 4 is transferred on the conveyor belt 15. To facilitate this process, it is advantageous for the driving means 26 of the gripping means 12 to comprise two pneumatic power cylinders 26', 26'' as shown in FIG. 2. In this case, the two cylinders, or an equivalent means, are coupled with each other by their piston rods and are separately controllable by regulation elements (now shown) connected to the central control unit 36. In this case it is preferable that the stroke of at least one of the cylinders, say 26', corresponds to the desired lift of the bobbin 4 together with the bobbin holder 5 for enabling the transverse swing of the conveying means 10 over the conveyor belt 15. The sum of the strokes of the two cylinders 26', 26'' should be at least as high as to ensure the displacement of the gripping means 12 together with the grippers 17, 18 to the position above the conveyor belt 15 even if processing a bobbin of the smallest diameter to be wound in the machine.

According to some variants of the device, the guide rod 29 need not be strictly linear but somewhat curved, or can take subsequent operative steps modified according to another structural arrangement of the machine, or the like.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A travelling service unit for exchanging wound bobbins removed from bobbin holders of a textile machine and for transferring them onto a conveyor belt arranged on the textile machine along said bobbin holders comprising bobbin gripping and conveying means with driving means coupled to an operation control unit;

said gripping means attached to the conveying means arranged on a frame of the travelling service unit; and conveying driving means for swinging said conveying means together with said gripping means transversely to a space above the conveyor belt about a longitudinal pivot extending in parallel to said conveyor belt;

said bobbin gripping means comprising a swinging gripper and a sliding gripper for seizing a wound bobbin at an outer diameter thereof, said swinging gripper and said sliding gripper being coupled to each other by a common pivot;

said swinging gripper having, outside said common pivot, a control arm coupled to gripping driving means secured to a sliding arm having a sleeve at its end;

said sleeve being coupled by means of a pivot to sleeve driving means and being adapted to slide along a guide rod and to swing together with said guide rod;

said guide rod being integral with one arm of a toggle lever arranged for swinging about said longitudinal pivot;

said guide rod having a control arm coupled by a pivot to said conveying driving means at one end of said conveying driving means; and another end of said conveying driving means being journalled about a pivot on the frame of the travelling service unit.

2. A travelling service unit as claimed in claim 1, wherein all of the driving means are pneumatic power cylinders.

3. A travelling service unit as claimed in claim 2, wherein the sleeve driving means for moving the gripping means along the guide rod comprises a pair of pneumatic power cylinders coupled with each other in series.

4. A travelling service unit as claimed in claim 1, wherein on the frame of the travelling service unit, a travel control sensor is provided for monitoring position of the grippers during travel of the gripping means, said sensor being connected to a control unit.

5. A travelling service unit as claimed in claim 2, wherein on the frame of the travelling service unit, a travel control sensor is provided for monitoring position of the grippers during travel of the gripping means, said sensor being connected to a control unit.

6. A travelling service unit as claimed in claim 1, wherein on the frame of the travelling service unit, a bobbin transfer control sensor is provided for monitoring the bobbin transfer position of the conveying means together with the gripping means above the conveyor belt, said sensor being connected to a control unit.

7. A travelling service unit as claimed in claim 2, wherein on the frame of the travelling service unit, a bobbin transfer control sensor is provided for monitoring the bobbin transfer position of the conveying means together with the gripping means above the conveyor belt, said sensor being connected to a control unit.

8. A travelling service unit as claimed in claim 4, wherein on the frame of the travelling service unit, a bobbin transfer control sensor is provided for monitoring the bobbin transfer position of the conveying means together with the gripping means above the conveyor belt, said sensor being connected to a control unit.

9. A travelling service unit as claimed in claims 5, wherein on the frame of the travelling service unit, a bobbin transfer control sensor is provided for monitoring the bobbin transfer position of the conveying means together with the gripping means above the conveyor belt, said sensor being connected to a control unit.

* * * * *